US005195306A

United States Patent [19]

Hadlock

[11] Patent Number: 5,195,306

[45] Date of Patent: Mar. 23, 1993

[54] PLASTIC SADDLETREE AND RIGGING

[75] Inventor: William B. Hadlock, New Braunfels, Tex.

[73] Assignee: Hadlock & Fox Manufacturing Company, New Braunfels, Tex.

[21] Appl. No.: 905,023

[22] Filed: Jun. 26, 1992

[51] Int. Cl.[5] ..... B68C 1/02

[52] U.S. Cl. ..... 54/44.7; 54/46.1

[58] Field of Search ..... 54/44.1, 44.5, 44.7, 54/46.1

[56] References Cited

U.S. PATENT DOCUMENTS

| | | | |
|---|---|---|---|
| 1,279,051 | 9/1918 | Webb | 54/46.1 |
| 3,293,828 | 12/1966 | Hessler | 54/44.7 |
| 3,371,467 | 3/1968 | Salisbury, III | 54/44.7 |
| 3,641,739 | 2/1972 | Stubben | 54/46.1 |
| 4,287,705 | 9/1981 | Frost et al. | 54/44.1 |

*Primary Examiner*—Robert P. Swiatek
*Attorney, Agent, or Firm*—Charles W. Hanor

[57] ABSTRACT

A saddletree constructed of upper and lower plastic shells which are secured together. A first strap passes inside the saddletree below the swell and pommel area and a second strap passes inside the saddletree below the cantle area, both may be attached to the upper surface of the lower shell near the centerline of the saddletree and depend from the saddletree on both sides of the attachment of other saddle rigging components.

16 Claims, 1 Drawing Sheet

PLASTIC SADDLETREE AND RIGGING

BACKGROUND OF THE INVENTION

1. Field of the Invention

The present invention is in the field of horseback riding saddles and is more particularly in the field of internal construction of western type saddles. The invention is directed toward improvement in the strength and reliability of the frame of the saddle, commonly called a saddletree, and the connections formed between the saddle and its girth or girths which hold it in place on the body of the horse.

RELATED ART

Riding saddles have been constructed of leather sewn and/or glued to a wooden core or saddletree for as long as saddles have had a form recognizable as such to a modern man, i.e. well over 150 years. Until about 1950 or later, the saddletree was typically made of wood, typically encased in a very tight sheath of rawhide shrunk in place and bonded with animal sinew glues. This rawhide cover and reinforcement was needed on most saddle grades, because without it, the saddletree might split and could not stand up to heavy duty, especially after a several years' aging. Construction of wood and rawhide saddletrees is relatively labor intensive and time consuming, therefore relatively expensive. With the drastic increases in labor costs over the past three decades, an incentive to find a replacement has existed.

Basic construction of saddles by sewing, screwing and nailing leather to the saddletree and to other layers of leather is basically unchanged to this day. The use of modern adhesives as an adjunct to sewing, increased use of hardware in such roles as rapid stirrup-length adjustment and the use of woven high strength synthetic straps in some highly stressed areas of the saddle's internal harness are examples of the small number of changes in saddle maker's art over the years.

One of the problems facing a saddle maker or designer is the need for strong attachment of the saddle girths to the saddle itself. This is accomplished by an assortment of straps, connecting hardware, and attachment systems known collectively as "rigging". There are many designs in use for rigging, varying not only with end use envisioned for the saddle, but also with regional tastes in what a saddle "should be" and individual saddle maker preferences. One thing, however, remains generally constant, attachments between the rigging and the saddletree are often made with screws, nails, bolts and leather ties, all of which require holes.

Conventional attachments are made on the upper surface of the saddletree, below and forward of swells, and in the area below and behind the cantle. These are relatively thin sections carrying the weight of the rider and forces from roping, etc. to the body of the horse and are thus subjected to flexural stresses.

One reason for the long term success of the wood and rawhide saddletree is that such a saddletree, constructed by a knowledgeable craftsman, will accept the aforementioned types of attachments well so that a saddle may remain useful for twenty years or more.

After the Second World War in which plastics lost most of their bad image and rapidly captured a number of markets due to their moldability and wide range of physical properties, saddle makers began to try to replace the wooden saddletree with a less expensive and possibly superior plastic substitute.

A wide range of both solid and hollow formed plastic saddletrees have been produced. Some have been commercially marketed, but none are believed to have been fully satisfactory because they share a common defect; repeated stress and flexure in the area of a line of holes often leads to a fracture through that line. Rigging carries the stresses of roping, bucking, etc. from the girths to the saddle, chiefly to the saddletree, and the strain is applied to said saddletree through the rigging attachments. Each of said attachments utilizes a number of screws or leather ties, bolts, nails, etc., each requiring its hole in said tree. Fractures often occur along a line containing the greatest concentration of such holes, sometimes in a very short time, usually within a few years for a well used saddle.

An object of the present invention is to supply a system of rigging attachment for a synthetic saddletree which will not require holes to be made in areas of maximum stress and flexure.

Another object of the invention is to reduce the number of parts used in attaching the rigging to a synthetic saddletree.

Yet another object of the present invention is to reduce the time and labor required to attach rigging to a synthetic saddletree through a major reduction in the number of fasteners required.

SUMMARY OF THE INVENTION

The present invention comprises a method of saddletree construction and attachment of rigging straps which obviates problems heretofore associated with the attachment of rigging to saddles.

Plastic material, preferably fiberglass, is used to mold an upper and lower shell which form a saddletree when assembled and attached together. At least two pair of slots in the upper shell, placed beneath the swells at the front of the saddle and at the base of the cantle near the rear of the saddle, allow a pair of rigging straps to be passed through the interior of the saddletree to depend on both sides of the saddle for the attachment of rigging components thereto.

Where these two straps pass over the upper surface of the lower shell inside the assembled saddletree, they are fastened to said lower shell near its centerline in order to prevent side-to-side motion of the rigging relative to the saddletree. Stress in this area is low, so that at least one relatively large rivet may be used to stabilize each strap, thereby requiring a minimum of two holes in the entire saddletree for attachment of the highly stressed girth rigging.

The saddletree, with rigging straps in place, may be further strengthened by filling the spaces between the upper and lower shells with a foam-in-place plastic material.

DETAILED DESCRIPTION OF THE PREFERRED EMBODIMENT

Figure 1:
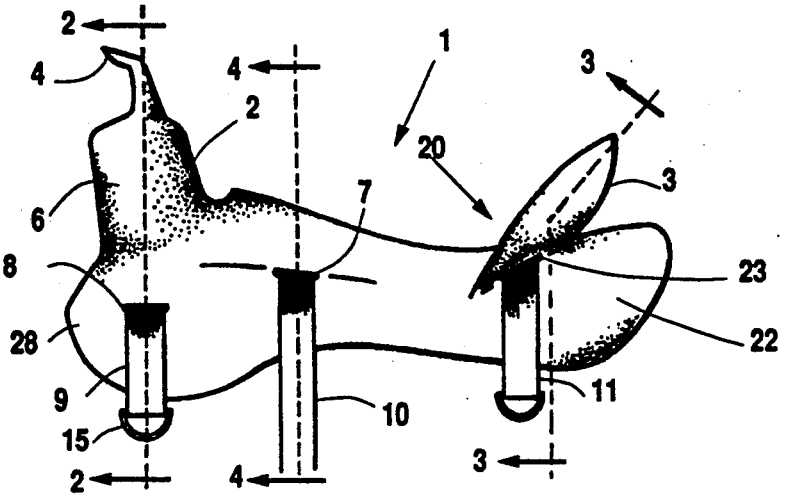
FIG. 1 is a side view of the completed saddletree with rigging anchor straps in place.
Figure 2:
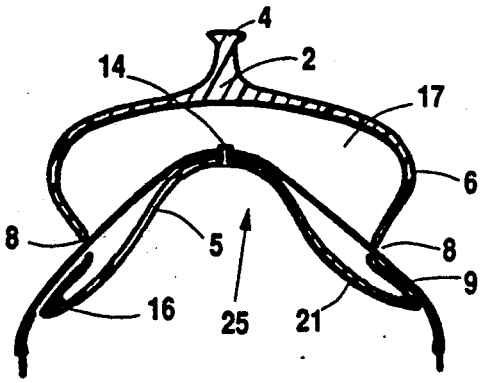
FIG. 2 is a cross-section view through line "A—A" showing the placement and anchoring of the forward rigging strap.
Figure 3:
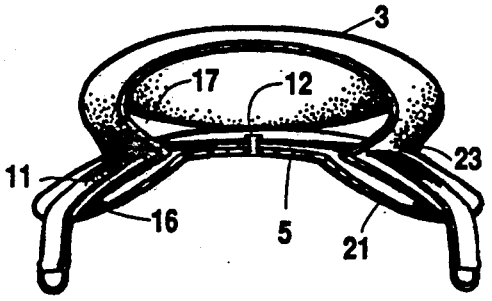
FIG. 3 is a cross-section view through line "C—C" showing the placement and anchoring of the rear rigging strap.
Figure 4:
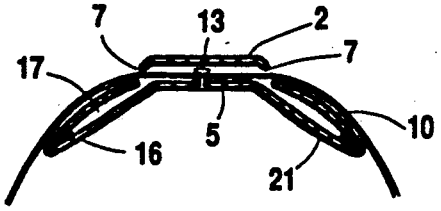
FIG. 4 is a cross-section view through the line "B—B" showing the placement and anchoring of the stirrup support strap.

FIG. 1 is a side or profile view of the saddletree comprising the present invention in its finished configuration. As seen in FIGS. 2, 3 and 4, saddletree 1 comprises: upper shell 2, lower shell 5, rigging straps 9, 10, and 11, and anchor elements 12, 13 and 14. "D" rings 15 do not constitute an integral part of the saddletree, as they are attached in a manner and location selected by the saddle maker or designer. They are illustrated here in order to clarify a typical means by which forces from the girths are transferred to said straps and thence into the saddletree through friction and anchor fastenings.

Upper shell 2 comprises a plastic material, usually fiberglass, formed to the contours of the upper surfaces of a saddletree and having a thickness of material in its various areas commensurate with the stresses to which it may be subjected. Thus the pommel 4 and its attachment area, which must take the stresses of anchoring a rope, is quite heavy. In contrast, the area 20 shown in FIG. 1, which carries a distributed load in a compound curved seat, may be adequately strong although much thinner. It is understood that the saddletree will be completed by a saddle maker by covering it with leather and accessories.

Lower shell 5 is formed to fit the body of a horse to distribute the weight of the rider and to form a secure connection in cooperation with the system of girths attaching the saddle to the horse. Shell 5 is also comprised of a plastic material, preferably the same material as shell 2. It is formed to mate with shell 2 around its perimeter and to be bonded with an adhesive such as epoxy to shell 2 in order to form a saddletree of relatively conventional shape and appearance. Assembled saddletree 1, however, has the unconventional addition of rigging straps 9, 10 and 11, depending respectively from slots 8, 7 and 23, as visible in FIG. 1. Saddletree 1 is bilateral symmetrical so that said straps and slots appear in mirror image on the opposite side as is evident in FIGS. 2, 3, and 4.

Referring to FIG. 2, it is seen that rigging strap 9 passes through slots 8 immediately below and on either side of swells 6 and below pommel 4. Strap 9 passes through cavity 17 between shell 2 and shell 5 and rides over the raised section 25 of shell 5 which is designed to clear the withers of a horse. At or near the longitudinal centerline of shell 2, strap 9 is attached to shell 5 by one or more rivets or other suitable attachments 14. Said attachment is in an area of minimum stress and flexure. Furthermore, pulls in either direction on strap 9 will be reduced by surface friction as strap 9 passes around the curve of raised area 25. FIG. 2 also shows smoothly curved zone 21 which carries weight and stresses to the body of the horse in a widely distributed area designed for comfortable fit to said horse. Also shown is bonding agent 16 in place in an assembled saddletree. Referring to FIG. 3, rigging strap 11 is shown passing through cavity 17 between upper shell 2 and lower shell 5 and emerging through slots 23 in shell 2 at the base of cantle 3 near the extremities of said cantle, thereafter passing over the upper rear surface of shell 2 indicated as 22 in FIG. 1. Strap 11 is fastened to shell 5 on or near its centerline by one or more fasteners 12. Said central fastening location is preferred for reasons including its low exposure to stress and flexure and because such a location works equally well for stresses from either side of the saddle.

FIG. 4 represents a cross-section view of the mid portion of saddletree 1 along line "B—B". Strap 10 passes through slots 7 on either side of shell 2, traverses cavity 17 between shell 2 and shell 5 and is fastened to shell 5 at or near its centerline with one or more rivet fasteners 13. Strap 10 is used to secure stirrups to saddletree 1 and as such may not be as highly stressed as strap 9 or strap 11. The same method of securing strap 10 is used, however, since this method results not only in the strongest and most reliable attachment at the least structural impairment to the saddletree, but is also a more economical method in terms of fasteners, material and labor.

Upper shell 2 may be bonded to lower shell 5 around the entire perimeter of saddletree 1 by a structural adhesive joint shown as 16 in FIGS. 2, 3 and 4. This bond is formed between prepared surfaces from which mold release agents have been removed. The adhesive agent used must have sufficient volume, adhesive compatibility, and body strength to form a bond at least as strong as the material from which shells 2 and 5 are constructed. A typical adhesive is epoxy glue. Said shells are clamped together with said bonding material in place there between and held motionless for a period sufficiently long for bond strength to reach a level allowing clamps to be removed.

Order of assembly will require straps 9, 10, and 11 to be attached to shell 5, then passed through slots 8, 7 and 23 respectively on both sides of shell 2 before bonding said shells together to form saddletree 1. "D" rings 15, if used, may be attached later. The saddletree assembly is now complete and may be stored to complete the cure of said bond prior to finishing by deburring, removing mold flashing and adhesive extrusions, etc.

Interior cavity 17, between upper shell 2 and lower shell 5 may be filled by foam-in-place structural plastic material such as polyurethane in order to achieve an added measure of structural strength to the structure of the saddletree and also to anchor rigging straps 9, 10 and 11 more firmly in place. Another method for increasing strength and ruggedness of the saddletree is to increase the thickness of material from which the upper and lower shells are constructed or by making them from a stronger class of plastic, i.e., an epoxy-glass combination or a system allowing an increase in the ratio of glass-to-resin in the finished unit.

Figure 5A:
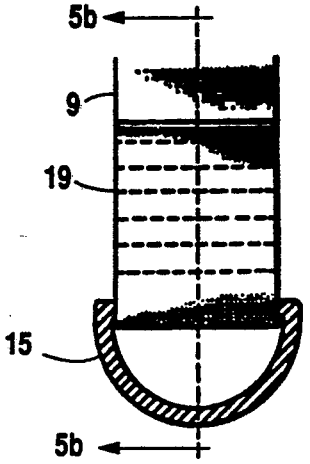
FIG. 5*a* is a front view of a typical attachment of rigging hardware to a rigging strap.
Figure 5B:
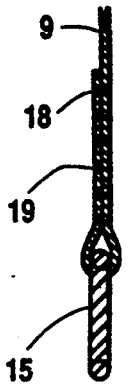
FIG. 5*b* is a side view of a typical attachment of rigging hardware to a rigging strap.

FIGS. 5*a* and 5*b* are shown to illustrate a typical method used by saddle makers to connect a saddle to a main and/or flank girth. The strap which directly connects to the saddletree, whether through leather and hardware attachments or through the method of the present invention, is here represented by strap 9. This strap is folded around the straight side of the saddle "D" ring 15 and folded back alongside itself. A series of cross stitching passes 19 are then used to secure said "D" ring to said strap 9. Riveting, leather thong ties, and lacing are a few alternative methods used to effect this type of joint on saddle straps. Whichever method is used, the "D" ring is now securely fastened to the saddle and serves as an attachment point for other gear, most notably the girth rigging. Strap 10, shown without a "D" ring, is usually sewn, laced, riveted or otherwise attached directly to the stirrup leathers by the saddle maker.

Pommel 4, shown in FIGS. 1 and 2 as an integral part of shell 2 and consisting of the same material, may be replaced by a metal pommel having a widely spread base. Such a metal pommel may be either molded directly into shell 2 or attached with adhesive and fasteners in a separate stage for those saddles which are to be used in heavy duty roping or other operations requiring extraordinary stresses on said pommel.

The saddletree as described above fulfills the objects of the present invention while adding little in either labor or material to the construction of a two piece shell type plastic saddletree. It eliminates attachment holes and fasteners and the stresses therefrom in the vulnerable lower skirt areas of the saddletree. This design also eliminates the necessity of adding leather and hardware attachment components to the saddletree in order to mount the necessary girth rigging attachment points.

The foregoing discussion is meant to convey the principle of applying one or more rigging straps across and inside at least a portion of a two-part plastic saddletree and fastening said straps to at least one of said parts inside the assembled unit. Variations of this idea may be numerous but the principle here disclosed comprises the basis of the present invention.

I claim:

1. In a saddletree forming the frame of a riding saddle, a construction and system for attachment of girths including:

an upper shell section formed of plastic material to the desired shape for the upper surfaces of the saddletree and having swells and a cantle, and a lower shell section formed of plastic material to the desired shape for the lower surfaces of the saddletree so as to form a complete saddletree when mated together;

said shells being bonded at least around their perimeter edges and having a cavity existing between said upper and lower shells;

slots in each side of said saddletree in the area below the swells for the passage of a first rigging strap there through;

a first continuous rigging strap passing between said upper and lower shells and depending from said saddletree through the slots located below the swells on both sides of the saddletree;

slots in each side of said saddletree in the area below the cantle for the passage of a second rigging strap there through; and a second continuous rigging strap passing between said upper and lower shells and depending from said saddletree through the slots located below the cantle on both sides of the saddletree.

2. The saddletree of claim 1 wherein:

said upper and lower shells are constructed of fiberglass.

3. The saddletree of claim 2 wherein:

said perimeter bond is made with a fiberglass-compatible epoxy adhesive.

4. The saddletree of claim 1 wherein:

the first rigging strap is fastened to the lower shell near its longitudinal centerline where said strap passes over said shell.

5. The saddletree of claim 4 wherein:

the second rigging strap is fastened to the lower shell near its longitudinal centerline where said strap passes over said shell.

6. The saddletree of claim 1 wherein:

the interior space between said upper and lower shells is filled with a foamed in place plastic.

7. In a saddletree forming the frame of a riding saddle, a construction and system for attachment of girths including:

an upper shell section formed of fiberglass to the desired shape for the upper surfaces of the saddletree and having swells and a cantle, a lower shell section formed of fiberglass to the desired shape for the lower surfaces of the saddletree so as to form a complete saddletree form when mated together;

said shells bonded together with a fiberglass-compatible epoxy adhesive around their perimeter edges and having a cavity existing between said upper and lower shells;

slots in each side of said saddletree in the area below the swells for the passage of a first rigging strap there through;

a first continuous rigging strap passing between said upper and lower shells and securely attached to said lower shell near its longitudinal centerline;

said strap depending from said saddletree through the slots located below the swells on both sides of the upper shell of said saddletree;

slots in each side of said saddletree in the area below the cantle for the passage of a second rigging strap there through; and a second continuous rigging strap passing between said upper and lower shells and securely attached to said lower shell near its longitudinal centerline, said strap depending from said saddletree through the slots located below the cantle on both sides of said saddletree.

8. The saddletree of claim 7 wherein:

the interior space between said upper and lower shells is filled by a foamed in place plastic.

9. A method of attaching girths to a saddletree forming the frame of a riding saddle, comprising the steps of:

forming an upper shell section of plastic material to the desired shape for the upper surfaces of the saddletree having swells and a cantle, and forming a lower shell section of plastic material to the desired shape for the lower surfaces of the saddletree so as to form a complete saddletree when mated together;

bonding said shells at least around their perimeter edges with a cavity existing between said upper and lower shells;

passing a first continuous rigging strap through slots in each side of said saddletree in the area below the swells between said upper and lower shells and depending from said saddletree through the slots located below the swells on both sides of the saddletree; and passing a second continuous rigging strap through slots in each side of said saddletree in the area below the cantle between said upper and lower shells and depending from said saddletree through the slots located below the cantle on both sides of the saddletree.

10. The method of claim 9, including the step of:

constructing said upper and lower shells of fiberglass.

11. The method of claim 9, including the step of:

forming said perimeter bond with a fiberglass-compatible epoxy adhesive.

12. The method of claim 9, including the step of:

fastening the first rigging strap to the lower shell near its longitudinal centerline where said strap passes over said shell.

13. The method of claim 12, including the step of:

fastening the second rigging strap to the lower shell near its longitudinal centerline where said strap passes over said shell.

14. The method of claim 9, including the step of:

filling the interior space between said upper and lower shells with a foamed in place plastic.

15. A method of attaching girths to a saddletree forming the frame of a riding saddle, comprising the steps of:

forming an upper shell section of fiberglass to the desired shape for the upper surfaces of the saddletree having swells and a cantle and forming a lower shell section of fiberglass to the desired shape for the lower surfaces of the saddletree so as to form a complete saddletree form when mated together;

bonding said shells together with a fiberglass-compatible epoxy adhesive around their perimeter edges with a cavity existing between said upper and lower shells;

passing a first continuous strap through slots in each side of said saddletree in the area below the swells between said upper and lower shells and securely attaching it to said lower shell near its longitudinal centerline; said strap depending from said saddletree through the slots located below the swells on both sides of the upper shell of said saddletree; and passing a second continuous strap through slots in each side of said saddletree in the area below the cantle between said upper and lower shells and securely attaching it to said lower shell near its longitudinal centerline, said strap depending from said saddletree through the slots located below the cantle on both sides of said saddletree.

16. The method of claim 15, including the step of:

filling the interior space between said upper and lower shells with a foamed in place plastic.

* * * * *